United States Patent [19]

Allen

[11] 4,424,932

[45] Jan. 10, 1984

[54] ELECTRIC SHOCK PROD

[76] Inventor: Gerald F. Allen, 4743 Brooks St., Montclair, Calif. 91763

[21] Appl. No.: 359,790

[22] Filed: Mar. 19, 1982

[51] Int. Cl.[3] ..... F41B 15/04

[52] U.S. Cl. ..... 231/2 E; 361/232; 273/84 ES

[58] Field of Search ..... 231/2 E; 361/232; 273/84 ES; 363/59, 60, 61

[56] References Cited

U.S. PATENT DOCUMENTS

| | | | |
|---|---|---|---|
| 1,317,278 | 9/1919 | Eastman | 361/232 X |
| 3,119,554 | 1/1964 | Fagan et al. | 231/2 E |
| 3,227,362 | 1/1966 | Laten | 231/2 E |
| 3,362,711 | 1/1968 | Larsen et al. | 231/2 E X |
| 3,917,268 | 11/1975 | Tingey et al. | 273/84 ES |

*Primary Examiner*—Robert P. Swiatek

*Attorney, Agent, or Firm*—Schwartz, Jeffery, Schwaab, Mack, Blumenthal & Koch

[57] ABSTRACT

The shock prod comprises a circuit for producing high-voltage electrical pulses. The circuit is mounted in a housing and communicates electrically with two conductors integral with a prod extension. The prod extension extends from the housing in a fixed predetermined direction with respect to the housing. The extension is elongated in the fixed direction, terminates in a free end, and is generally flat with a high width-to-thickness ratio, having sufficiently high flexural rigidity and buckling resistance to avoid excessive deflection or deformation in use. With this novel configuration, the extension is constrained to bend in a preferred plane parallel to the thickness dimension. Loads applied in the other planes produce torsional deflection so as to allow bending in this preferred deflection plane. This wide, thin cross-section permits a wide electrode spacing simultaneously with a thin bending surface, resulting in the following: A minimum bending radius which greatly reduces instances of breakage; allows electrification and desired electrode spacing over any desired portion of the prod extension; eliminates need for separate electrode mounting hardware; remains operational even if the extension is snapped in two, when a sufficient electrode-conductor spacing geometry exists along the length of the prod extension.

22 Claims, 18 Drawing Figures

ELECTRIC SHOCK PROD

BACKGROUND OF THE INVENTION

1. Field of the Invention

The present invention relates to portable, hand-held shock producing devices which can be used as prods for livestock or for controlling crowds and the like.

2. Discussion of Related Art

Electric shock prods are generally hand-held devices that are thrust axially and sometimes laterally against the subject, usually human or animal, to apply an electric shock. Every prod contains a housing which provides a handle or other holding fixture and contains the electrical components of the device. Every prod also provides some prescribed separation or extension between the operator and the point of electrode-to-subject contact. Prior prod designs can be placed in one of the following categories:

(1) The configuration shown in FIGS. 1 and 2 which comprises a component housing and the prod extension combined in one structure such as tube 2. Insulator 5 covers the end of the tube from which electrodes 6 and 7 extend. For component preservation, the tube 2 must be rigid and not subject to significant deformation or deflection. Furthermore, the cross-section of tube 2 must be large enough to house the components which include batteries. Tube 2 usually has an internal diameter on the order of ¾ inch to one inch and a thickness usually on the order of 1/32 inch. A typical prod with a one inch I.D. and 0.035 inch thick wall can be shown by basic strength formulas to have a bending moment of well over 200 foot-pounds. Such a prod is very hazardous to the operator if the prod were to become wedged between, for example, a fence post and a large moving animal. The 200 foot-pound strength is sufficient to throw a man or cause him to lose control and drop the prod. Additionally, the extended center of gravity, shown at 3, of such a prod assembly makes the prod extremely unwieldy. With a typical 12 inches between the handle 1 and the center of gravity 3, the torque exerted through the operator's hand is unacceptable. Examples of patents which disclose prods similar to that shown in FIGS. 1 and 2 are: U.S. Pat. Nos. 3,998,459 to Henderson; 3,917,268 to Tingey; 2,441,819 to Haffner; and 2,204,041 to Jefferson.

(2) The most practical and popular prod designs available today are represented by the prod shown in FIGS. 3 and 4 in which the handle 11 is integral with the electrical component housing 10. A separate prod extension pole 14 is connected to the housing 10. Consequently, the design of the prod extension pole 14 is not compromised by the component-housing requirements. The prod extension pole 14 is usually a round fiberglass pole approximately ⅜ inch in diameter containing two conductors 18, 19 connected to the electrodes 16, 17 which are secured by a plastic fixture 15. A simplified collet-chuck arrangement 13 secures the cantilevered extension pole 14 to the main housing. A comfortable balance can be achieved with the center of gravity 12 usually located close to the handle grip area. Replaceable extensions of various lengths are generally available. This type of prod design can be seen in U.S. Design Pat. No. 175,158.

Some designs electrify the periphery of the rigid portion of the electrode mounting by use of appropriately spaced conductors. As seen in U.S. Pat. No. 2,981,465 to Bartel, such electrode extensions are helically wound around the rigid electrode head. The prod otherwise is similar to that shown in FIG. 2. Another example of exposed peripheral electrodes can be seen in U.S. Pat. No. 3,819,108 to Jordan. In Jordan, conductors are located about the periphery of a rigid cylindrical pole or stick which is similar in construction to the tubular body of FIG. 1. U.S. Pat. No. 3,119,554 to Fagan et al shows another example of external electrodes used on an electric shock prod. In Fagan et al, the conductors are located axially along the periphery of an insulating rod.

U.S. Pat. No. 2,561,122 to Juergens shows a highly resilient coupling used between the prod pole extension and the housing/handle. The coupling is analagous to the well-known coil-spring vehicular antenna mounts. Such a spring coupling is functional for simple lateral loads applied near the free end of the pole. However, bending moments or lateral loads near the resilient mounting could result in severe lateral deflection of the mounting, which deflection is restrained ultimately only by the strength of the mounting or the pole. In other words, the resilient coupling would not stop the pole or other prod parts from breaking in the presence of loads or torques which tend to cause extreme lateral excursions of the couplings.

U.S. Pat. No. 4,006,390 to Levine shows a prod assembly with an extendable electrode. Several mechanisms are used for extending the electrode including a pneumatically-actuated rolled tube which is similar to a "blow-out" party favor and a self-unwinding preformed spring web or strip in which the unwinding portion forms a thin-walled cylindrical type tube. The inherent weakness of such extendable beam designs is limited lateral rigidity. Lateral impacts easily cause local buckling deformation or rupture of the thin-walled extendable shells. This characteristic lack of flexural rigidity results in the inability to survive slashing or whipping strokes which are unavoidable in any hostile environment.

U.S. Pat. No. 3,227,362 shows an electric slapper prod. The electrode extension is in the form of a flat belt-like or razor-strap-like assembly of pliable material such as fabric or leather with embedded flexible wires running lengthwise to two laterally, not axially, projecting screws which serve as electrode tips. This invention is characterized by its construction from high plasticity materials with a consequent lack of lateral and axial flexural rigidity. Accordingly, the device is used strictly for slapping. Useful extension of the slapper occurs only as a result of the tensile load imposed by centrifugal or inertial forces caused by the rotating or swinging action of the operator's hand.

Various major problems are inherent in known prod assemblies. For instance, with reference to FIGS. 2 and 3, fiberglass prod extensions 14 tend to snap frequently. This is due to the fact, as shown by basic structural deflection formulas, that the minimum bending radius which can be attained before fracture for a ⅜-inch diameter polyester fiberglass pole is approximately 17 inches. Thus, it is obvious that a prod extension would necessarily snap when caught in a tight squeeze between, for example, an animal and a loading chute. Also, the electrode fixture 15 and electrodes 16 and 17 are subject to extreme bending loads during routine encounters with the ground and other objects. Typical brass electrode pins 3/16 inch diameter by one inch in length are frequently bent by the impacts encountered which in turn usually fractures the plastic electrode fixture 15. Further, the torque exerted by the typical prod extension pole is on the order of 210 inch-pounds when flexed to near its limit. This torque applies up to 300 pounds of force to the small area of contact within a typical plastic chuck assembly 13. This kind of cantilever coupling is not capable of reliably withstanding the bending moments applied and thus often fractures.

Switch constructions in electric prods are also a problem. On-off switching in electric prods of the FIG. 1 configuration is often accomplished by axial pressure against the subject which depresses either the electrode assembly 5 or the tube 2 so as to close switch contacts. This type of switch construction is impractical in realistic environments of, for example, livestock processing, where debris quickly clog telescoping fittings or switches. The on-off switch in a design similar to FIG. 2 is usually located under the handle portion 11 for easy access by the index finger. With no wraparound shield, the switch and any additional items such as a charger connector are fully exposed to dirt and impact breakage, although to a lesser extent than is characteristic in designs similar to FIG. 1.

Also, on-off switches, particularly in the current fed induction coil high-voltage generators used in electric prods, are subject to high-voltage arcing and consequent contact destruction at the instant the switch is turned off, and during contact bounce periods. This is related to the voltage generated when current feeding a charging inductance is cut off. Depending upon transient conditions prevailing in an oscillating inductance-charging circuit when the switch contacts are opened, the voltage spikes appearing across the switch terminals may be of either or both polarities and, unchecked, can reach several hundred volts. Prior prod devices have done nothing to suppress this arcing.

SUMMARY OF THE INVENTION

One object of the present invention is to provide an electric shock prod having a stiff, elastic prod extension of wide thin cross section to minimize breakage to levels which are not attainable in the prior art.

Another object of the present invention is to provide an electric shock prod having a prod extension with a low bending moment which, by virtue of the wide thin cross section, reduces the restraining torque that must be resisted by an operator as well as by the extension-to-housing attachment points thus reducing the probability of breakage at the attachment points.

Another object of the present invention is to provide an electric shock prod which eliminates the need for protruding electrode tips and thus diminishes the problem of skin or hide puncture damage. The protruding tips are eliminated by virtue of the geometrical properties of the prod itself which allow electrodes to be exposed and capable of contacting a subject without the need of using protruding electrodes.

Yet another object of the present invention is to provide an electric shock prod having a wide flat prod extension geometry which permits conductors to be embedded in the extension in any one of several configuratrions without sustaining strain rupture of the conductors in the presence of severe flexing of the extension.

Another object of the present invention is to provide, by virtue of the wide thin extension cross section, an extension that readily lends itself to the application of any one of a variety of electrode conductor patterns exposed along the edges and even surfaces of the prod extension so as to most efficiently apply electric shock to the intended subject.

A still further object of the present invention is to provide, by virtue of the thin wide cross section, a prod extension in which the electrode geometry is maintained over any desired length thereof, and which is, therefore, easily replaceable or repairable in the field in the event of end damage or fracture.

A further object of the present invention is to provide an electric shock prod having a housing assembly with an integrally formed handle, which housing assembly connects to the prod extension such that the prod extension acts as a protective shield or guard for the operator's hand and operative components such as the on-off switch and battery charger connector terminal of the prod.

Another object of the present invention is to provide various electronic circuit functions in an electric shock prod, including: charger connector short circuit of the internal battery pack; battery charging indicator; transient supression circuitry; electronic limiting of no load output voltage pulses; and audio/visual operating status indicators.

BRIEF DESCRIPTION OF THE DRAWINGS

The above and other objects of the present invention will become more readily apparent as the same is more fully set forth in the detailed description, reference being had to the accompanying drawings in which like reference numerals represent like parts throughout, and in which.

DETAILED DESCRIPTION OF THE PREFERRED EMBODIMENT

Figure 1:
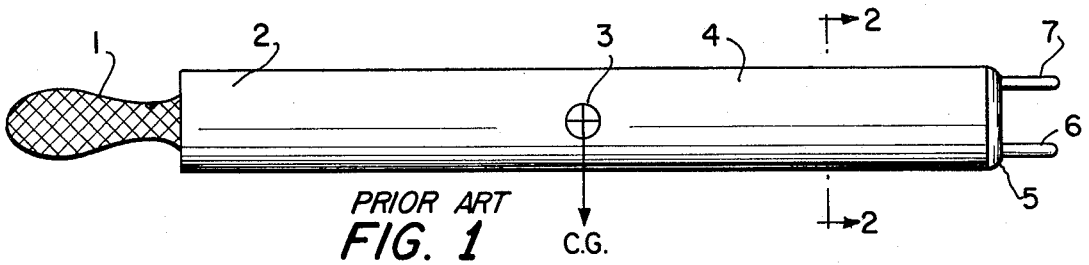
PRIOR ART FIG. 1
FIG. 1 is an elevational view showing one basic structural configuration of a conventional prior art prod.
Figure 2:
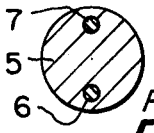
PRIOR ART FIG. 2
FIG. 2 is an end view of FIG. 1.
Figure 4:
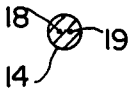
PRIOR ART FIG. 4
FIG. 4 is a transverse sectional view taken along a plane passing through line 4—4 of FIG. 3.
Figure 3:
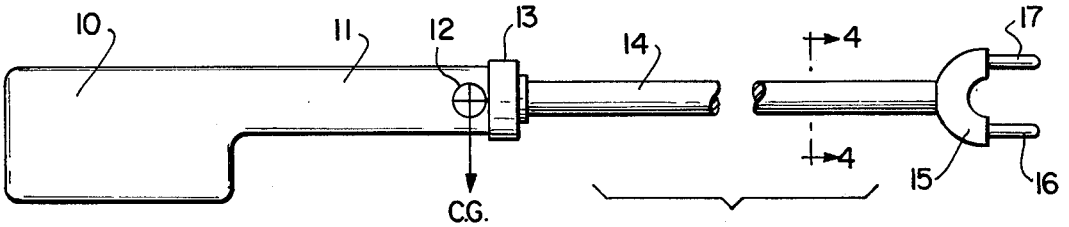
PRIOR ART FIG. 3
FIG. 3 is an elevational view of a second embodiment of a prior art prod.
Figure 5:
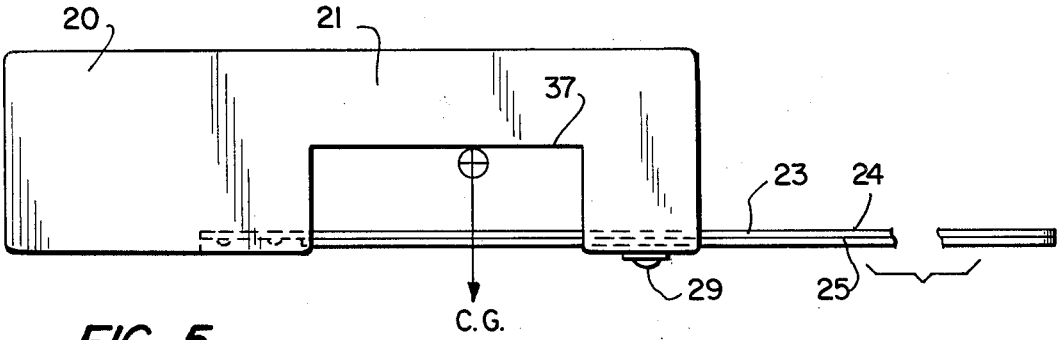
FIG. 5 is an elevational view of an electric shock prod according to the present invention.
Figure 7:
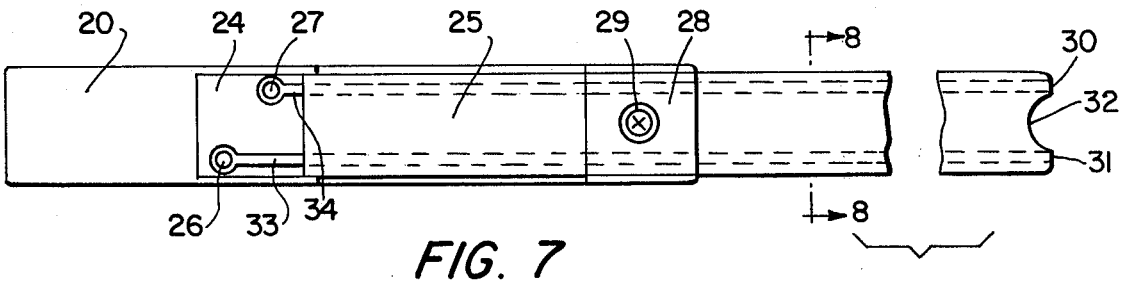
FIG. 7 is a bottom plan view of the shock prod of FIG. 5.
Figure 6:
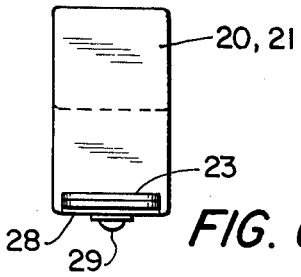
FIG. 6 is an end elevational view of the shock prod of FIG. 5.
Figure 8:
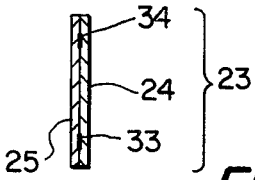
FIG. 8 is an end sectional view taken through line 8—8 of FIG. 7 showing the construction of the prod extension of the present invention.

FIGS. 5, 6, 7 and 8 show a first embodiment of the electric shock prod of the present invention. The shock prod comprises a housing 20 which is attached to a prod extension 23 by bolts 26, 27 and 29. Simple flat-surface bolting of the prod extension 23 to the prod housing 21 affords a strong, easily-replaceable extension mounting, eliminating the need for precision highly-stressed cantilever coupling nuts and fittings which are inherently subject to much higher restraining force levels.

The prod extension 23 comprises a stiff, elastic beam of wide, thin cross-section. Excellent results have been obtained by producing the beam from epoxy glass laminate. The beam can be approximately $\frac{1}{8}$ inch thick, $1\frac{1}{4}$ inch wide and approximately two feet long (beyond the housng point of attachment). The beam structure cross-section should either be solid or thick walled to avoid local buckling or rupture damage. The flexural rigidity must be sufficient to avoid excessive deflection during quick lateral movements as well as to exert sufficient axial compressive loads during axial movements such as thrusting impacts against the body of a subject. Increasing the flexural rigidity increases the maximum bending moment that must be resisted by the prod operator. It also increases the minimum bending radius of the prod extension. The thin-beam concept of the present invention as shown in FIGS. 5–8 provides a shorter minimum bending radius and a lower bending moment than have been achieved by prior devices.

Using the epoxy glass material discussed above, a minimum bending radius as low as three inches can be achieved in the case of a typical $\frac{1}{8}$ inch thick prod extension. The bending torque is likewise minimal, being for a typical flat prod extension of $1\frac{1}{4}$ inch width and $\frac{1}{8}$ inch thickness, about 82 inch-pounds or 6–8 foot pounds.

While epoxy glass material has proven to be highly effective in use, other materials can be used. The following chart lists material properties and ranges of each property which are deemed to be suitable for use in the prod extension of the present invention.

| Property | Range | Typical G-10 Epoxy Glass Material |
|---|---|---|
| Flexural Strength (S) | $10\text{–}60 \times 10^3$ psi | $36\text{–}50 \times 10^3$ psi |
| Flexural Elastic Modulus (E) | $.25\text{–}5 \times 10^6$ psi | $2.5 \times 10^6$ psi |
| Modulus of | 100–300 psi | 250 psi |
| Resilience ($S^{2/2E}$) | 100–300 psi | 250 psi |
| Flexural Rigidity (EI) | 400–800 lb.-in.$^2$ (for an 18 inch length) | 400 in-lb.$^2$ (for an 18 inch length) |
| Minimum Bending Radius | Less than 12 inches | 3 inches |

Due to the high width-to-thickness ratio of the beam, severe deflection occurs in a preferred plane which is parallel to the thickness dimension. Deflecting loads in other planes produce torsional deflection which allows bending to occur in the preferred plane. Consequently, all significant lateral deflection occurs in one plane, that being parallel to the thickness dimension.

Prod extension 23, shown in FIGS. 5–8, may be fabricated from two sheets of material, 24 and 25, bonded together with conductors 33 and 34 sandwiched between so as to remain in the neutral bending plane. This avoids fatigue-inducting strain on the conductor material. The prod extension can be fabricated by using a sheet of epoxy glass material such as NEMA grade G-10 for member 24 with electrode conductors 33 and 34 being in the form of a printed circuit on sheet 24. A second piece of blank G-10 material 25 is positioned on and bonded to sheet 24 so as to leave the mounting area of sheet 24 exposed. This simplified construction eliminates the need for plated-through holes for contacting bolts 26 and 27. Holes can be drilled or punched in sheet 24 to allow bolts 26 and 27 to pass through. The ends of conductors 33 and 34 are naturally exposed as shown at 31 and 30. A relief 32 can be cut between ends 31 and 30 to complete the prod extension. Since the cross-section of the extension is narrow, intimate contact with the shock subject is readily obtained without excessive pushing of the prod extension. The relief cut 32 enhances tip penetration by further reducing contact area.

This construction, maintaining electrode spacing over the length of the extension, makes it possible to restore operation of a damaged prod extension. In the event of damage, the end can simply be trimmed if necessary and resanded to the desired shape to fully restore the prod. Even snapped extensions can be restored in this manner. Of course, the length of the refurbished extension is limited by the point of fracture.

The prod extension 23 is primarily mounted to housing 20 by bolt 29 which passes through a stress distribution piece 28 and prod extension 23 into a mating threaded hole formed in housing 20 forward of handle 21. Piece 28 is merely a square or rectangular blank of material similar to that from which sheets 23 and 24 are formed. Piece 28 is cut to match the shape of the housing forward of handle 28 against which extension 23 lies. The mounting surface on housing 20 against which extension 23 lies is normally a flat surface approximately $1\frac{3}{4}$ inch long and $1\frac{1}{4}$ inch wide thus affording a high bending moment resisting mount. The handle itself is formed along a recess 37. The prod extension beam extends completely across recess 37 and thus serves to protect operative elements of the prod such as the start switch and external battery charger connector which are disposed in the recess. The deflection of extension 23 across recess 37 is not significant and thus bolts 26 and 27 are not noticeably stressed by deflection of the extension. Accordingly, the mounting structure for bolts 26 and 27 need not be excessively strong.

The prod extension 23 does not flex laterally; i.e., in the plane of the width dimension, but is restrained by the sides of the housing 20 at both sides of recess 37. Recess 37 is typically six inches in length. Bending torque applied laterally cannot appreciably deflect the extension, but instead torsionally deforms the extension until a degree of twist is achieved which allows flexure in the thickness plane. Because of the long moment arm, the reaction forces between the housing sides and prod extension are small and readily accommodated by the normal structural strength of the housing sides and the mounting bolts 26, 27 and 29.

The housing is basically rectangular in shape except for indentation 37 which provides a handle at region 21. The size of the portions on each side of handle 21 and the distribution of components within housing 20 can be adjusted to permit an optimum balance point in the center of handle 21 at 22. Furthermore, as discussed above, the portion of the prod extension spanning recess 37 naturally shields the operator's hand along with switches, connectors, indicators and the like mounted in the recess.

Figure 9:
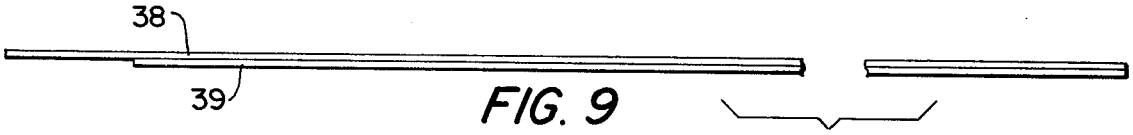
FIG. 9 is a side view of a second embodiment of a prod extension according to the present invention.
Figure 10:
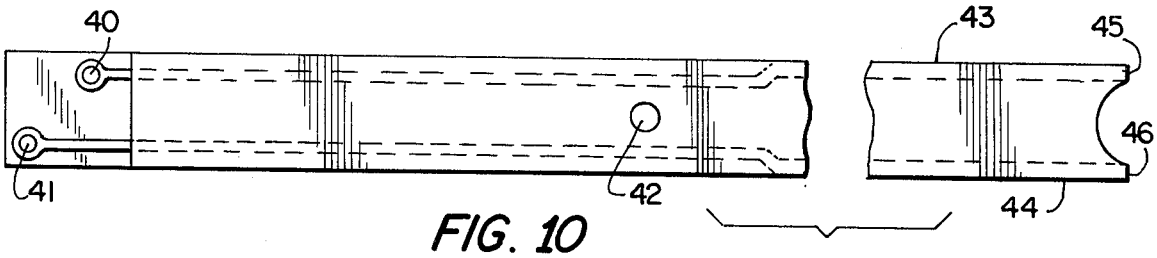
FIG. 10 is a bottom plan view of the prod extension of FIG. 9.

FIGS. 9 and 10 show a second embodiment of the prod extension which can be used with housing 20. The embodiment shown in FIGS. 9 and 10 is adapted for law enforcement use in that the electrode conductors are brought to the edges of the extension beyond the handle region at 43 and 44, respectively. The conductors terminate in ends 45 and 46 at the free end of the extension. Typical mounting holes are clearly indicated at 40, 41 and 42 through which bolts 26, 27 and 29 would pass to attach the prod extension to housing 20. The electrified edges at 43 and 44 serve to shock anyone attempting to grab the prod extension to remove the prod from the hands of the user.

Figure 11:
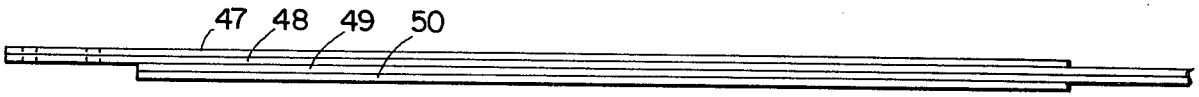
FIG. 11 is a side view of a third embodiment of a prod extension according to the present invention.
Figure 12:
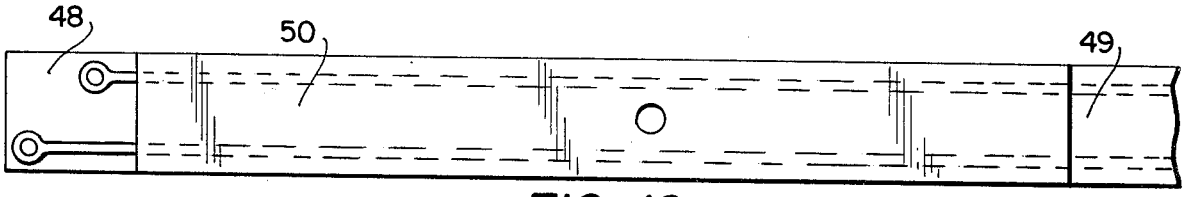
FIG. 12 is a bottom plan view of the prod extension of FIG. 11.

FIGS. 11 and 12 show a third embodiment of the prod extension which can be attached to housing 20 by use of the appropriate mounting holes. The embodiment of FIGS. 11 and 12 includes an additional thickness of material over a portion of the extension to increase flexural rigidity. The additional thickness is achieved by bonding sheets 47 and 50 to sheets 48 and 49. Sheets 47 and 50 extend only partway beyond the handle section of the prod extension. Sheets 47 and 50 may be of the same material as sheets 48 and 49 and bonded to those sheets in any convenient manner.

Figure 13:
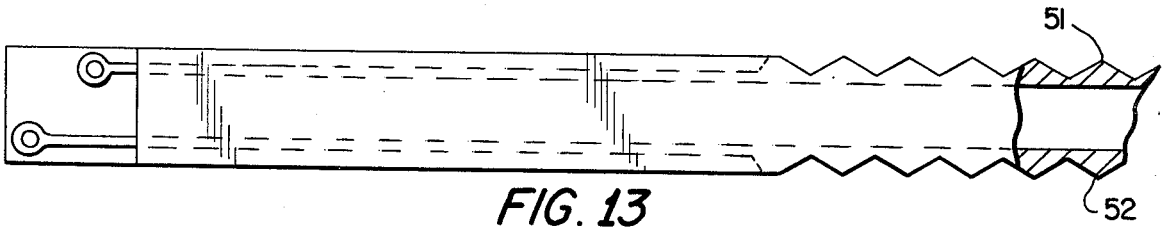
FIG. 13 is a bottom plan view of a fourth embodiment of a prod extension according to the present invention.

FIG. 13 shows a fourth embodiment of a prod extension according to the present invention. The embodiment shown in FIG. 13 demonstrates a low-cost method of manufacture wherein only a single thickness of material, 51, is used. Foil conductors 52 and 53 are connected to material 51 using, for example, printed circuit techniques and have a zigzag pattern designed to minimize the unit strain induced by deflection, to an acceptable value. Severe strain results from the outer surface location of the conductors. Being away from the neutral bending plane, the conductors are subject to severe stretching and compressing in accord with basic principles of bending. The steeper the slope of the zigzag pattern, the lower the unit strain. To electrify the extreme edges of the prod extension of FIG. 13, the patterns extend to the edges as shown at 55 and 56. A mechanically and electrically protective coating 54 may be applied over the surface of material 51 on which conductors 52 and 53 are contained.

Figure 14:
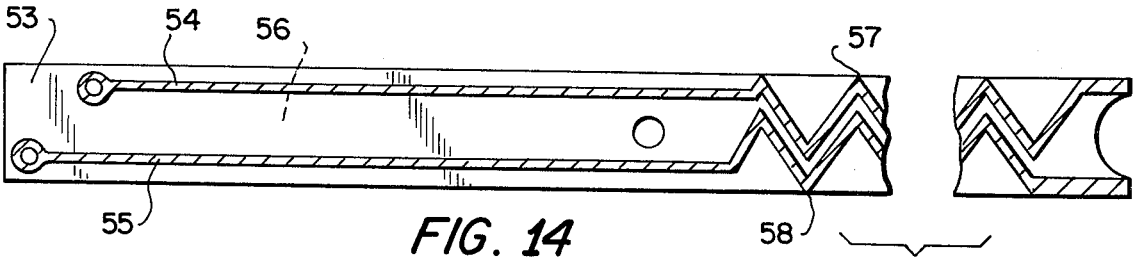
FIG. 14 is an elevational plan view of a fifth embodiment of a prod extension according to the present invention.
Figure 15:
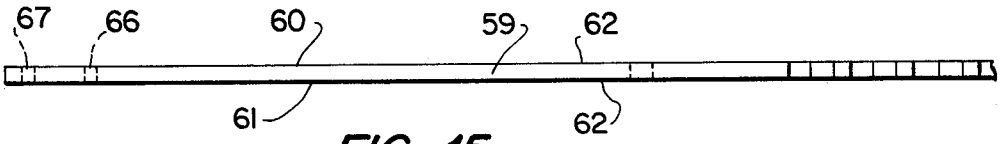
FIG. 15 is a bottom plan view of the prod extension of FIG. 14.

Electrification of each of the exposed wide surfaces of the prod extension of any of the exemplary embodiments may be achieved as shown in FIGS. 14 and 15, by passing conductive eyelet rivets, 57, terminals or the like through the flat surfaces, so that each one contacts its respective conductor. A number of pairs of such eyelets may be arranged in accord with design requirements.

Figure 16:
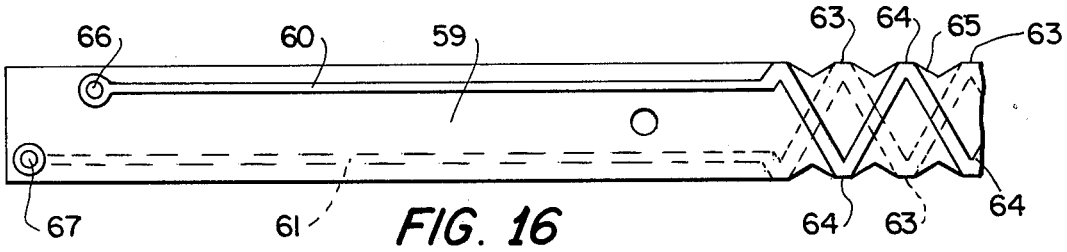
FIG. 16 is a bottom plan view of a sixth embodiment of a prod extension according to the present invention.

FIG. 16 shows a sixth embodiment of the prod extension of the present invention. The embodiment of FIG. 16 consists of a single piece of printed circuit board material 59 such as G-10 described hereinabove with double-sided copper foil, etched away to form complimentary conducting paths 60, 61. One conducting path is formed on each side of the board with holes 66 and 67 plated through, if desired. A zigzag pattern is provided for minimizing strain as discussed above. Additionally, in the embodiment of FIG. 16, the edges of the extension are cut in a saw-tooth pattern 65 as shown so as to reduce contact area and increase penetration into, for example, the gloves covering the hand of a person attempting to grab the prod away from the user. The saw-tooth edges, combined with a sufficiently high, no-load prod output voltage, minimize the possibility that a hand grabbing the prod extension can avoid shock. Similar saw-tooth edges may be used with any embodiment of the invention.

To reduce the probability of strain failure of the conductors, the thickness of material 59 may be reduced considerably, limited only by dielectric strength and applied voltage. For a strength of 500 v/mil, and a maximum voltage of 10 kv, a 20 mil thickness would suffice. Such a double-sided material may be centrally sandwiched between two other sheets to provide necessary flexural rigidity. A saw-tooth profile pattern 65 may be cut or otherwise formed along the edges of the prod extension to increase contact pressure, as discussed above. The alternating points 63 and 64 of the complimentary zigzag conductor patterns are exposed along the edges providing electrode pairs along any desired length of both edges of the extension. Of course, the ends of electrodes 60 and 61 can be brought out to the tip of the prod extension as in the previously described embodiments. An insulative or mechanically protective coating 62 may also be applied to the prod extension, if desired.

Figure 17:
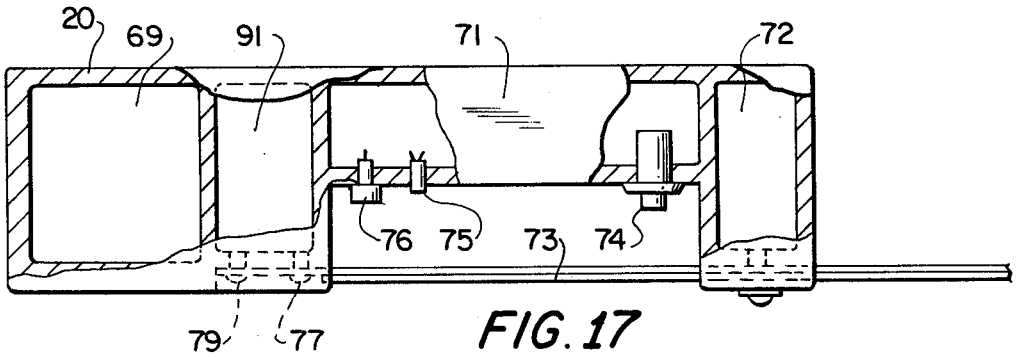
FIG. 17 is a side elevational view of a typical prod extension housing according to the present invention.

FIG. 17 shows a typical practical prod arrangement which may be used in law enforcement and other heavy duty applications. A finned heat sink structure 74 is positioned to dissipate heat generated by internal components and also serves as a protective mounting for battery-charger connector 75, charge indicator 76 and operating indicator 77. Another finned structure 78 is used to house one or two operating indicators 79 so as to display a more menacing appearance and warning to hostile individuals subject to shock prod use. Protection is also afforded the user's hand by prod extension 72. On-off switch 73 is positioned for index finger operation. Internal components such as batteries and transformer are positioned within handle 20 to obtain the desired balance and connect with high voltage terminals 68, 69. Electronic components may be mounted within the handle portion 21. Two prod extension mounting bolts are shown.

Figure 18:
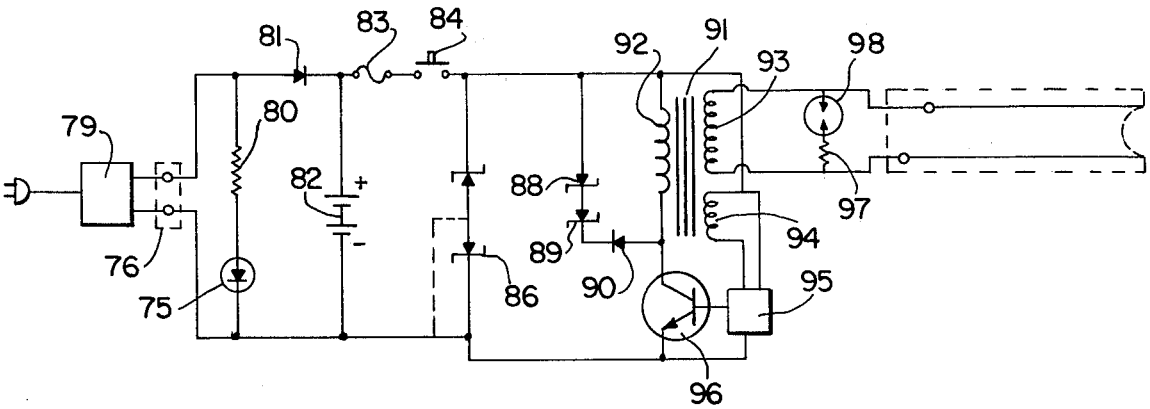
FIG. 18 is a block diagram showing the electric prod circuit features of the present invention.

FIG. 18 shows a representative circuit block diagram, detailing only what is pertinent to the invention. Each block represents a known circuit configuration and thus, a detailed description of the individual blocks will not be entered into. A battery charging and indicator network 81 verifies that battery pack 83 is being charged by illuminating an L.E.D. when charging network 80 is attached through connector 75. Typically, network 81 can comprise an L.E.D. in series with a resistor with the L.E.D. and resistor connected in parallel with another resistor. Should connector 75 become short circuited, diode 82 is reverse-biased by the battery 83, thereby isolating the battery and high-voltage generator from the otherwise-disabling and hazardous short-circuit.

High-voltage transients experienced in high-voltage generators when the on-off switch 73, is turned off, or opens during contact-bounce periods, can reach several hundred volts of either polarity, and the resulting switch-contact arcing greatly reduces switch life. This can be prevented by installing a zener diode capacitor network or the like, as shown at 84.

In a typical current-fed high-voltage blocking-oscillator type of pulse generator, a pulse of several hundred volts may be developed across the inductor winding 87, of transformer 88, when the transistor 92 is cut off, and when the output secondary winding 90 is unloaded. To protect the transistor 92, and to limit the secondary voltage to a safe level (to avoid arcing or corona effects) a peak limiter network 85 is added. Newtork 85 may comprise a resistor.

In typical blocking oscillator circuits, transformer feedback winding 90 drives semiconductor 92 through feedback/biasing network 91. The prod extension conductors are connected to the high-voltage output winding 89.

Other circuits or means of high voltage generation may be used in accordance with the objects of this invention, and any circuit details shown are only exemplary. The use of different semiconductor devices and arrangements will often necessitate logical changes in polarity of various diodes, etc., as would be obvious to one of ordinary skill in the art. Even electromechanical induction coil generators of the "Model T Spark Coil" type are applicable.

One, two, or more L.E.D. operation indicators may be incorporated in an audio/visual operating status indicator network 86, to signal that the high voltage generator is working, and to warn potential subjects of the impending shock/pain. When high voltage pulses are generated, the LEDs are forward biased and will therefore light. The LEDs of network 86 may be connected in series with the peak limiter network 85.

A loud buzzing is often produced by inexpensive shock prod designs as a result of a loose transformer lamination or core assembly, but is usually an adequate acoustic signal. In more expensive reliable designs, the potential deterioration of a vibrating core is prevented by clamping or encapsulating the transformer, thereby eliminating the loud buzzing noise. In such instances, an auxiliary audible indication may be desirable and can be installed in a manner analagous to the L.E.D. visual example.

The foregoing is considered illustrative of the present invention but should not be considered limitative thereof. Obviously, numerous other modifications, additions and changes may be made to the present invention without departing from the scope thereof as set forth in the appended claims.

What is claimed is:

1. An electric shock prod apparatus, comprising:

circuit means for producng high-voltage electrical pulses;

a housing mounting said circuit means;

a prod extension attached to said housing and extending from said housing in a fixed, predetermined direction with respect to said housing, said extension comprising: a beam, said beam being elongated in said direction and terminating in a free end, said beam being flat with a large width-to-thickness ratio and being made from a stiff, non-pliable, material having high flexural strength and buckling resistance; and two eletrodes attached to said beam and spacedly supported thereby, said electrodes extending along said beam and being exposed at portions of said beam and being connected to said circuit means for transmitting said pulses to said exposed portions for delivering a shock to a subject contacted by said exposed portions.

2. The apparatus as set forth in claim 1, wherein said beam has a flexural strength in the range of 10,000 psi to 60,000 psi.

3. The apparatus as set forth in claim 1, wherein said beam has a flexural elastic modulus in the range of 250,000 psi to 5,000,000 psi.

4. The apparatus as set forth in claim 1, wherein said beam has a modulus of resilience of 100 psi to 300 psi.

5. The apparatus as set forth in claim 1, wherein said beam has a flexural rigidity of 400 lb-in$^2$ to 800 lb-in$^2$.

6. The apparatus as set forth in claim 1, wherein said beam has a minimum bending radius less than 12 inches.

7. The apparatus as set forth in claim 1, wherein said housing is a unitary construction containing a recessed portion forming a handle.

8. The apparatus as set forth in claim 1, wherein portions of said electrodes are exposed at said free end and along opposite longitudinal edges of said beam.

9. The apparatus as set forth in claim 1, wherein said electrodes are disposed in a zigzag pattern extending along said beam.

10. The apparatus as set forth in claim 9, wherein portions of said electrodes are exposed at said free end and along opposite longitudinal edges of said beam.

11. The apparatus as set forth in claim 1, wherein said housing includes a handle portion and a pair of extension mounting surfaces to which said extension is attached.

12. The apparatus as set forth in claim 11, wherein said extension mounting surfaces are disposed forward and rearward of said handle portion such that said extension extends across said handle portion.

13. The apparatus as set forth in claim 1, wherein said beam is unitary in construction.

14. The apparatus as set forth in claim 13, wherein said electrodes are flat conductors.

15. The apparatus as set forth in claim 1, wherein said extension is a laminated construction comprising a plurality of laminations.

16. The apparatus as set forth in claim 15, wherein said electrodes are sandwiched between two of said laminations.

17. The apparatus as set forth in claim 9, wherein said electrodes are formed on opposite sides of said beam.

18. The apparatus as set forth in claim 1, wherein said circuit means includes a power source having a battery, and a battery recharging circuit and a diode connected between said battery and said battery recharging circuit, said diode being oriented to prevent a short circuit in said battery charging circuit from affecting said battery.

19. The apparatus as set forth in claim 1, wherein said circuit means includes a high-voltage generator, a power supply, and an on-off switch disposed between said power supply and said high-voltage generator, and a transient suppression network connected so as to protect said power supply and said switch.

20. The apparatus as set forth in claim 19 and further wherein said high-voltage generator includes a charging inductance and a peak limiter network across said charging inductance to limit no load voltage peaks to a safe level to avoid arcing, as well as excess voltage-level damage to generator components.

21. The apparatus as set forth in claim 1, wherein said electrodes are attached to said beam in a neutral bending plane of said beam.

22. The apparatus as set forth in claim 1, wherein separate electrode projections are affixed to at least some of said portions.

* * * * *